United States Patent [19]

Habicht et al.

[11] 4,397,116

[45] Aug. 9, 1983

[54] FIRE RESISTANT DOOR

[75] Inventors: Siegfried Habicht, Leopoldshöhe; Heinz Gerss, Bielefeld, both of Fed. Rep. of Germany

[73] Assignee: Schüco Heinz Schürmann GmbH & Co., Bielefeld, Fed. Rep. of Germany

[21] Appl. No.: 210,763

[22] Filed: Nov. 26, 1980

[30] Foreign Application Priority Data

Nov. 29, 1979 [DE] Fed. Rep. of Germany ..... 2948039
Nov. 29, 1979 [DE] Fed. Rep. of Germany ... 7933612[U]

[51] Int. Cl.[3] ..... E06B 3/00

[52] U.S. Cl. ..... 49/501; 52/716; 49/DIG. 1

[58] Field of Search ..... 49/366, 370, 501, 504, 49/401, DIG. 1; 52/716, 717, 718, 476, 398, 403

[56] References Cited

U.S. PATENT DOCUMENTS 3,703,063 11/1972 Budich et al. ..... 49/504 X
4,164,107 8/1979 Kraemling et al. ..... 52/476 X
4,164,108 8/1979 Ortmanns ..... 52/476 X

FOREIGN PATENT DOCUMENTS 2823317 5/1978 Fed. Rep. of Germany ... 49/DIG. 1

*Primary Examiner*—Kenneth Downey
*Attorney, Agent, or Firm*—Michael J. Striker

[57] ABSTRACT

A fire resistant door has at least one swingable leaf which includes a glass plate. The swingable leaf comprises an inner frame composed of one or two tubular subframes having a general plane and a rigid outer cover frame. The outer frame has lateral walls surrounding the inner frame. The inner frame is formed with walls extending parallel to the general plane of the sub-frame, which walls together with lateral walls of the outer sub-frame form grooves. A support element is mounted in each groove which has an arresting projection whereas the lateral walls are formed with arresting webs extending towards the arresting projections and connected to the latter forming a force and form-locking connection.

14 Claims, 4 Drawing Figures

FIRE RESISTANT DOOR

BACKGROUND OF THE INVENTION

The present invention relates in general to fire resistant doors and more particularly to frames serving to support a glass plate of the door.

Prior art systems have employed doors which have at least one swingable leaf. Such leaf normally includes a sub-frame made of square tubes and outer frames which are commonly made of light material. The outer frames are provided with arresting webs rigidly connected to supporting means which are secured to walls extending in a plane transverse to a general plane of the square-tubular sub-frame. These supporting means are usually positioned in the region of walls of the outer frame and are limited by construction means for securing the edges of the glass plate or outer frame to the frame of the door leaf. This makes the structure bulky and inconvenient to use.

SUMMARY OF THE INVENTION

It is an object of the invention to provide an improved fire resistant door.

Another object of the invention is to provide a structure of a fire resistant door with swingable leaves where the region of frame walls extending in a plane transverse to the plane of the glass plate is free from supporting means and available for accommodation of steel profiles or tubular profiles made as one-piece elements.

These and other objects of the invention are attained by a fire resistant door with at least one swingable leaf including a glass plate, the swingable leaf comprising an inner frame composed of at least one tubular steel sub-frame having a general plane and a rigid outer cover frame of light metal, said outer cover frame including lateral walls surrounding said inner frame and being provided with portions extending parallel to said general plane and forming grooves with said lateral walls, said lateral walls being formed with arresting webs extending into said grooves.

The door may further include a second swingable leaf; said one swingable leaf and said second swingable leaf define two parts of the door.

The door may further comprise a number of supporting elements each mounted in the assigned groove and rigidly supported therein.

Each of the supporting elements may be formed with an arresting projection, said arresting projection extending toward the respective one of said arresting webs and being engaged with said arresting web in a force and form-locking connection.

The inner frame may have a base. A mounting member may be provided in the structure, said mounting member having a cammed surface and being rigidly connected to said base. The mounting member may be welded to said base. The mounting member may be screwed to said base.

The door may further include a glass-supporting member made of rolled steel sheet and rigidly connected to said base, said glass-supporting member being adapted to support one side of the glass plate.

The glass-supporting member may have a portion engaging said cammed surface of the mounting member.

The tubular steel sub-frame may be made of rolled sheet material.

The tubular steel sub-frame may be formed with a projection outwardly extending from said base, said projection being adapted to support another side of the glass plate.

The outer frame may be formed with two extensions, said extensions projecting from said lateral walls toward the glass plate and in a plane transverse to the plane of the glass plate, said glass-supporting member, said projection and said extensions peripherally surrounding the glass plate.

Said extensions may have free end portions in the region of the glass plate, said free end portions being formed with supporting webs.

A second tubular steel sub-frame may be provided in the inner frame, said second sub-frame being spaced from said one tubular steel sub-frame to define a space therebetween.

The door may further include a profile of fire and high temperature-resistant material, said profile being mounted in said space and connected to said one and second sub-frame.

This profile may be plate-shaped.

Said profile may be made of asbestos-containing material.

Said profile may be clamped between said one and second sub-frames.

Said profile may be connected to said one and second sub-frames by screws.

Said profile may be connected to said one and second sub-frames by rivets.

This profile may extend in said space over the entire length of said one and second sub-frames.

It should be noted that the glass plate supported in the door leaf is subjected to heating not only from direct action of the fire but is also subjected to indirect heating at the side away from the fire due to heat transmission from the frame profile in the region when the same clamps the glass plate.

In order to overcome or reduce this temperature differential between the side of the glass plate subjected to fire and the side facing away from fire the afore-mentioned profile of fire-resistant material is clamped between two sub-frames.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
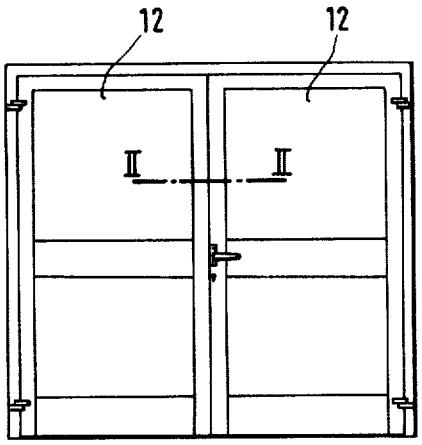
FIG. 1 is a front view of a fire resistant door which has two swingable leaves.
Figure 2:
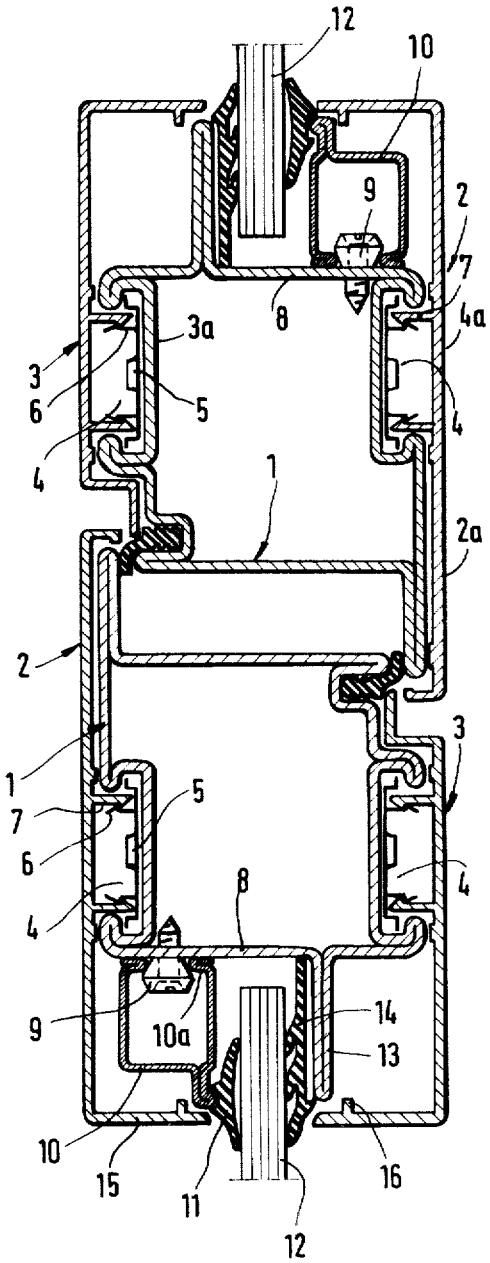
FIG. 2 is a sectional view taken along line II—II of FIG. 1 turned through 90°.

Referring to FIGS. 1 and 2, it is seen that a fire-resistant door with two swingable leaves is illustrated. FIG. 2 shows a section of an adjoining part of two leaves 2 and 3 each provided with a glass plate 12. Each leaf comprises an inner frame 1 composed of one tubular steel sub-frame and an outer cover frame 2a made of light material or the like. The outer frame is normally prefabricated and rigidly connected to the sub-frame 1. The tubular sub-frame 1 is formed with walls 3a whereas the outer frame is formed with lateral walls 4a which extend parallel to a general plane of the sub-frame. The walls 3a together with the walls 4a constitute anchoring grooves 4 in which supporting elements 5 are rigidly supported. The supporting elements 5 have arresting projections 6 outwardly extending from the walls 3a. The lateral walls or their portions 4a in turn are formed with arresting webs 7 projecting towards projections 6 and connected with them in a force and form-locking connection. Each tubular sub-frame has a base wall 8 which carries a mounting member 9 which is either a cam or a bar having a cammed surface. The mounting member 9 is fastened to the base wall 8 by any known fasteners such as bolts (as shown in FIG. 2) or welded to the base wall 8. The mounting member 9 serves to support a glass-supporting element 10 which is made of sheet steel material. The upper portions 10a of the element 10 engage the cammed surface of the mounting member 9 so that the glass-supporting element is clamped on the element 9 and thereby connected to the base wall 8. As is clearly seen in FIG. 2 the free end portion of the element 10 is engaged with a glass-sealing profile 11 which in turn holds the glass plate 12. A supporting projection or web 13 is provided on the base wall 8 of the sub-frame 1, which web extends towards a second glass-sealing profile 14 which is positioned opposite to the profile 11. The web 13 supports the glass-sealing profile 14 which is engaged with the glass 12.

The outer frame 2a is formed with two projections 15 which extend toward each other and in a plane transverse to the plane of the glass 12. The lateral walls 2a together with projections 15 enclose the glass 12. The projections 15 have supporting webs 16 which extend towards the base wall 8.

The tubular steel profiles of the foregoing construction which have two walls spaced from one another, define a space therebetween which is filled by air and provide the fire and smoke resistant structure of the door with swingable leaves. By having grooves 4 and webs 7 connected to projections 6 of the outer frame this structure provides the reliable rigid construction which is advantageous comparatively to the conventional type of doors.

Figure 3:
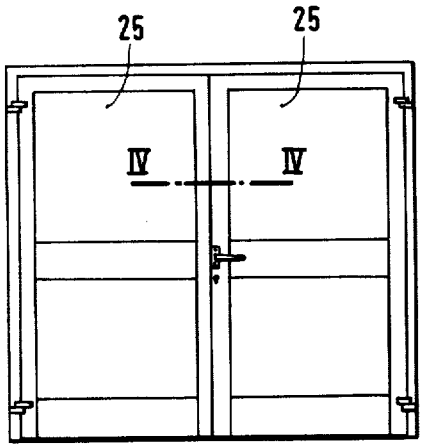
FIG. 3 is a front view of a fire resistant door with two swingable leaves showing another embodiment of the invention.
Figure 4:
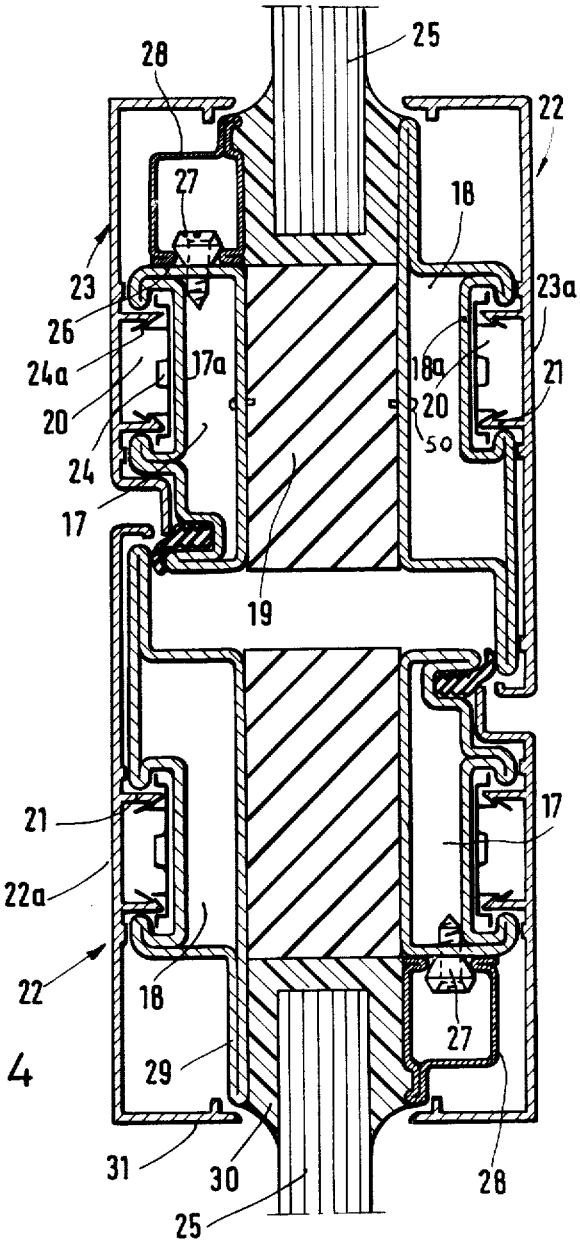
FIG. 4 is a sectional view taken along line IV—IV of FIG. 3 but turned through 90°.

Referring to FIGS. 3 and 4, a second embodiment of the invention is shown. In this embodiment, each swingable leaf includes the inner frame which is composed of two tubular steel sub-frames 17 and 18, which sub-frames are spaced from one another so as to define a space therebetween. In this space a profile 19 of high temperature-resistant material is clamped between two sub-frames 17 and 18. The material of the profile 19 may generally contain asbestos. This profile is very brittle and does not have the sufficient rigidity. In order to strengthen the construction the sub-frames 17 and 18 are prefabricated by rolling and in assembly are connected to the profile 19 by means of screw 50 or rivets not shown in the drawing. In this embodiment the sub-frames 17 and 18 are clamped opposite one another and the profile 19 is clamped between them.

The profile 19 shown in FIG. 4 is a plate-shaped element which extends in the space between the sub-frames over the entire length of the sub-frames 17 and 18. In the second embodiment, each frame 22 or 23 of each swingable leaf also comprises an outer frame 22a having portions extending parallel to the general plane of a glass plate 25. The sub-frames 17 and 18 are formed with walls 17a, 18a facing away from the profile 19 which together with walls 22a (23a) form respective anchoring grooves 20. Similarly to the embodiment illustrated in FIGS. 1 and 2, the structure shown in FIGS. 3 and 4 is also provided with supporting elements 24 rigidly supported within the grooves 20 and formed with arresting projections 24a. These projections are mounted in a force and form-locking connection with arresting webs 21 formed on the outer frame 22 (23). A web 26 similar to the base wall 8 shown in FIG. 2 is provided in the sub-frame on which a cammed element 27 is rigidly mounted by means of screws or by welding. The web 26 extends in a plane transverse to the plane of the glass plate 25. A glass-supporting member 28 of rolled sheet steel is clamped on the cammed member 27 which serves to support one side of a glass-sealing member 30. One of the sub-frames is formed with a projection or web 29 adapted to support another side of the glass-sealing member 30 which engages the end portion of the glass plate 25. The outer frames 22 (23) by their extensions 31 enclose the glass-supporting member 28 and the web 29.

It will be understood that each of the elements described above, or two or more together, may also find a useful application in other types of a fire resistant door differing from the types described above.

While the invention has been illustrated and described as embodied in a fire resistant door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fire-resistant door, comprising at least one swingable leaf including an inner frame comprised of two tubular steel sub-frames spaced from each other to form a space therebetween, a profile of fire and high temperature-resistant material clamped between said sub-frames; an outer frame of light metal surrounding said inner frame and rigidly connected thereto; a glass plate having a general plane and an end portion located within said frames, said outer frame having lateral walls facing said tubular sub-frames, said sub-frames having wall portions extended parallel to said general plane and spaced from said lateral walls such that anchoring grooves are formed between said lateral walls and said wall portions; and supporting elements each rigidly supported in the respective anchoring groove and provided with arresting projections, said lateral walls of the outer frame being formed with arresting webs extending in said grooves towards said wall portions and engaging said arresting projections of the supporting elements in a force and form-locking connection.

2. The door of claim 1, wherein said inner frame has a base, and a mounting member is provided, said mounting member having a cammed surface and being rigidly connected to said base.

3. The door of claim 2, wherein said mounting member is welded to said base.

4. The door of claim 2, wherein said mounting member is screwed to said base.

5. The door of claim 2, further including a glass-supporting member made of rolled steel sheet and rigidly connected to said base, said glass-supporting member being adapted to support one side of the glass plate.

6. The door of claim 5, wherein said glass-supporting member has a portion engaging said cammed surface of said mounting member and being clamped thereon.

7. The door of claim 6, wherein said tubular steel sub-frame is made of rolled sheet material.

8. The door of claim 7, wherein said tubular steel sub-frame is formed with a projection outwardly extending from said base, said projection being adapted to support another side of the glass plate.

9. The door of claim 8, wherein said outer frame is formed with two extensions, said extensions projecting from said lateral walls toward the glass plate and in a plane transverse to the general plane of the glass plate, said glass-supporting member, said projection and said extensions peripherally surrounding the glass plate.

10. The door of claim 9, wherein said extensions have free end portions in the region of the glass plate, said free end portions being formed with supporting webs.

11. The door of claim 1, wherein said profile is plate-shaped.

12. The door of claim 11, wherein said profile is made of asbestos-containing material.

13. The door of claim 11, wherein said profile is connected to said one and second sub-frames by screws.

14. The door of claim 11, wherein said profile extends in said space over the entire length of said one and second subframes.

* * * * *